US011505983B1

(12) United States Patent
Crockett

(10) Patent No.: US 11,505,983 B1
(45) Date of Patent: Nov. 22, 2022

(54) SYNCHRONIZED VEHICLE WINDOW CONTROL SYSTEM

(71) Applicant: Tywon Crockett, Lawrenceville, GA (US)

(72) Inventor: Tywon Crockett, Lawrenceville, GA (US)

( * ) Notice: Subject to any disclaimer, the term of this patent is extended or adjusted under 35 U.S.C. 154(b) by 510 days.

(21) Appl. No.: 16/653,051

(22) Filed: Oct. 15, 2019

(51) Int. Cl.
*E05F 15/695* (2015.01)
*E06B 7/28* (2006.01)
*H01H 25/04* (2006.01)

(52) U.S. Cl.
CPC ..... *E05F 15/695* (2015.01); *E06B 7/28* (2013.01); *H01H 25/04* (2013.01); *E05Y 2400/415* (2013.01); *E05Y 2900/55* (2013.01)

(58) Field of Classification Search
CPC ..... E05F 15/695; E05Y 2400/415; E05Y 2900/55; E06B 7/28; H01H 25/04
USPC ..... 701/49
See application file for complete search history.

(56) References Cited

U.S. PATENT DOCUMENTS 8,786,417 B2 7/2014 Holmen
2004/0154904 A1* 8/2004 Varga ..... H01H 25/04 200/5 A
2016/0167605 A1* 6/2016 Rego ..... E05F 15/695 307/9.1
2018/0016837 A1* 1/2018 Bulpitt ..... E05F 15/70

FOREIGN PATENT DOCUMENTS

EP 1978535 A2 * 10/2008 ..... B60N 2/0228
JP 2004169529 A * 6/2004

* cited by examiner

*Primary Examiner* — Mahmoud Gimie
(74) *Attorney, Agent, or Firm* — Sanchelima & Associates, P.A.; Christian Sanchelima; Jesus Sanchelima

(57) ABSTRACT

A vehicle window control system including a vehicle assembly and a control assembly is disclosed herein. The vehicle assembly includes a vehicle having a driver door having a driver window and passenger doors having passenger windows. The windows are each controlled by an electric motor preciously existing in the vehicle. The driver door further includes a control area having the control assembly mounted thereon. The control assembly includes a switch panel that allows a user to control the windows of the vehicle. The control assembly allows a user to automatically sync all of the windows of the vehicle from the control area of the driver door. Additionally, the vehicle window control system allows a user to have all of the windows of a vehicle to lower a predetermined amount when the vehicle is engaged.

8 Claims, 3 Drawing Sheets

SYNCHRONIZED VEHICLE WINDOW CONTROL SYSTEM

BACKGROUND OF THE INVENTION

1. Field of the Invention

The present invention relates to a vehicle window control system and, more particularly, to a vehicle window control system located on the driver's side that allows a driver to control all the windows of a vehicle simultaneously.

2. Description of the Related Art

Several designs for a vehicle window control system have been designed in the past. None of them, however, include a conventional motor vehicle having a plurality of vertically adjustable windows which are driven by electric motors. The motors are each controlled by a central control unit that drives the motors based on user switch input. The switch panel includes a single rocker switch that corresponds to a single window motor. Additionally, the switch panel includes a synchronizing switch provides simultaneous control of all vehicle windows. It is known that vehicles often have multiple switches and buttons located on the driver side to control the windows of a vehicle. It is also known that a user may often desire to roll down all of the windows of a vehicle to a predetermined even amount. Therefore, there is a need to a vehicle window control system that allows a user to automatically sync all the windows of a vehicle to a single control panel. The control panel is configured to roll down all of the windows of a vehicle simultaneously.

Applicant believes that a related reference corresponds to U.S. Pat. No. 8,786,417B2 issued for a vehicular window adjustment by means of a haptic-enabled rotary control knob. The reference includes a haptic assembly configured to control a plurality of windows on a vehicle. The assembly further includes a haptic device configured to provide haptic feedback to a user when switching between the plurality of windows. Additionally, haptic feedback is provided when moving a selected window of the plurality of windows between an open position and a closed position. The assembly can also include a graphical user interface configured to display icons that represent each of the plurality of windows. However, it differs from the present invention because the U.S. Pat. No. 8,786,417B2 reference fails to address the issue of having all of the windows of a vehicle to be simultaneously lowered with the use of a single control. The reference also fails to provide a system that allows a user to configure the windows of a vehicle to be lowered a predetermined amount when the vehicle is started. The present invention addresses this issue by providing a control assembly that allows a user to automatically sync all of the windows of a vehicle and lower all of them simultaneously. Additionally, the system may be configured to lower the windows a predetermined amount when the vehicle is started.

Other documents describing the closest subject matter provide for a number of more or less complicated features that fail to solve the problem in an efficient and economical way. None of these patents suggest the novel features of the present invention.

SUMMARY OF THE INVENTION

It is one of the objects of the present invention to provide a vehicle window control system that allows a user to automatically sync all the windows on a vehicle to a single control assembly disposed on a driver door.

It is another object of this invention to provide a vehicle window system that allows a user to automatically roll down a driver window and passenger window a predetermined amount when the motor of a vehicle is engaged.

It is still another object of the present invention to provide a vehicle window control system that allows a user to toggle between having the control assembly control all the windows on a vehicle or having the control assembly only control the driver window.

It is yet another object of this invention to provide such a device that is inexpensive to implement and maintain while retaining its effectiveness.

Further objects of the invention will be brought out in the following part of the specification, wherein detailed description is for the purpose of fully disclosing the invention without placing limitations thereon.

BRIEF DESCRIPTION OF THE DRAWINGS

With the above and other related objects in view, the invention consists in the details of construction and combination of parts as will be more fully understood from the following description, when read in conjunction with the accompanying drawings in which.

DETAILED DESCRIPTION OF THE EMBODIMENTS OF THE INVENTION

Figure 1:
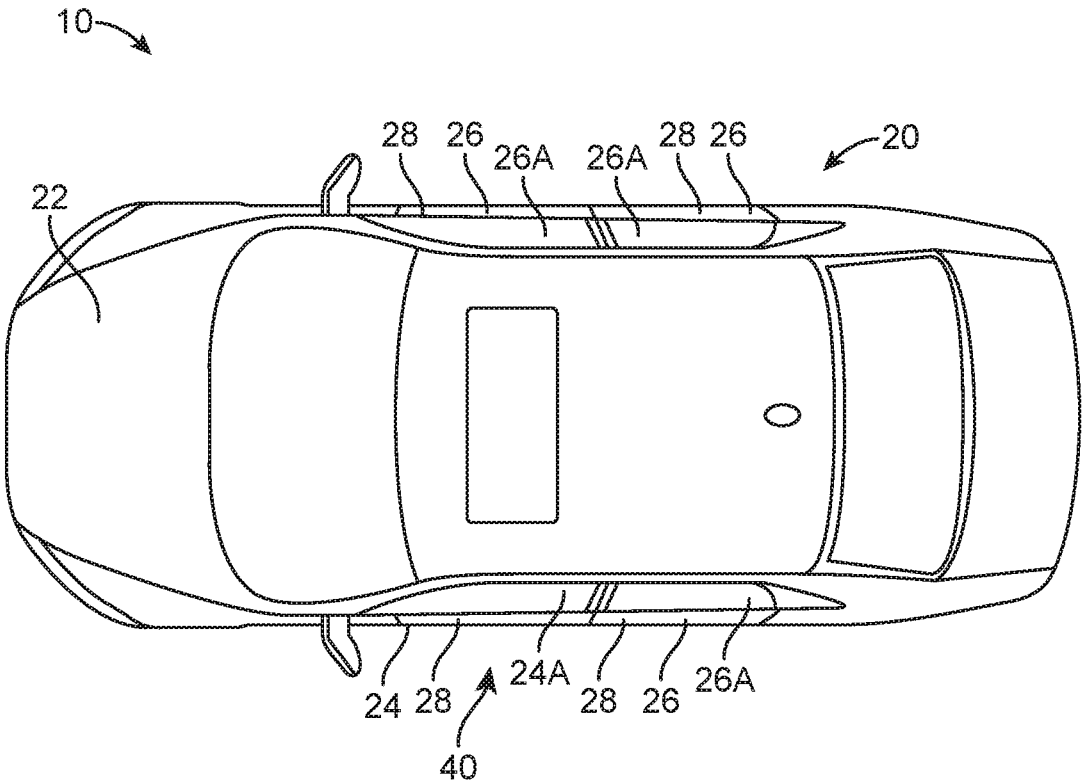
FIG. 1 represents a top view of a vehicle window control system 10 wherein a vehicle assembly 20 may be viewed in accordance to an embodiment of the present invention.
Figure 2:
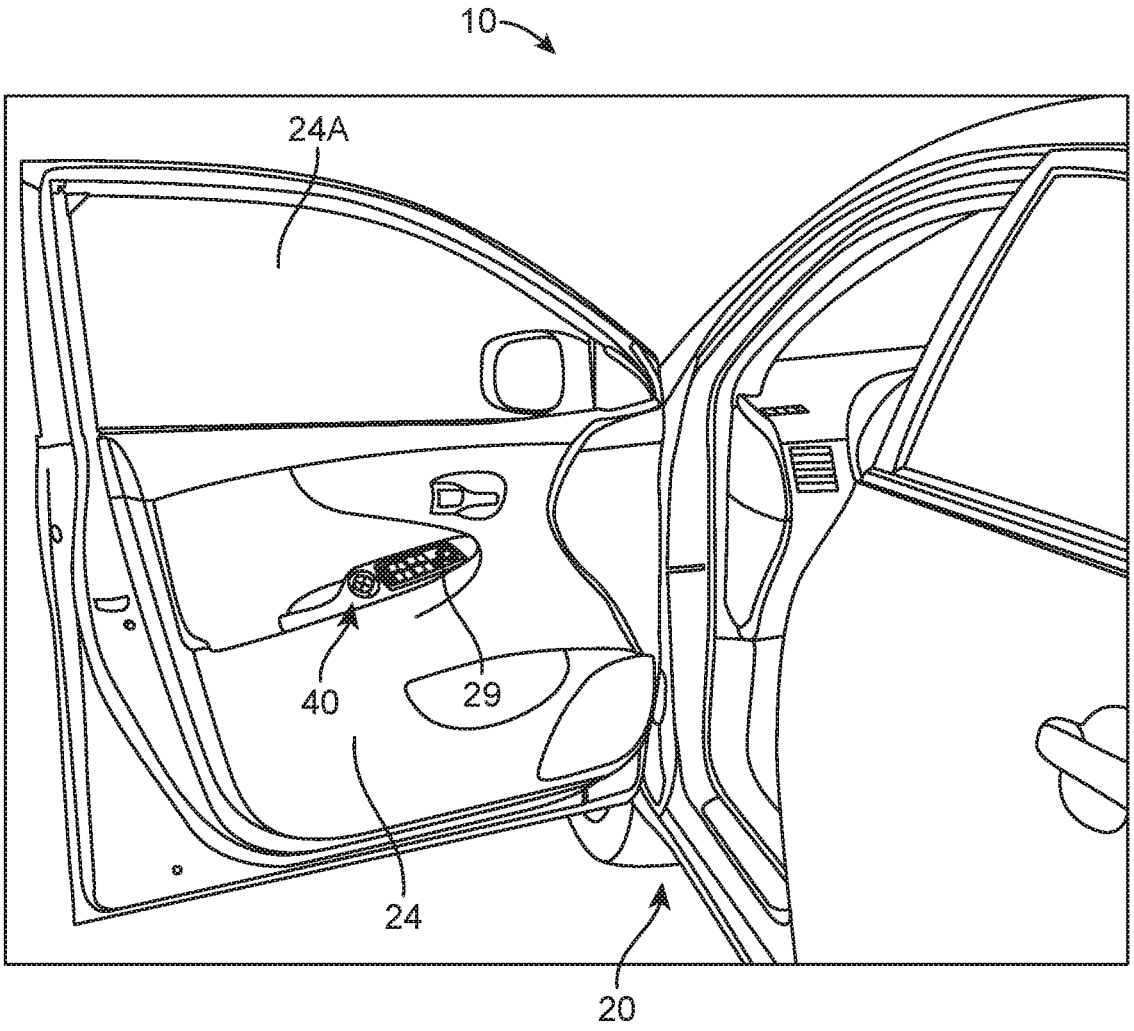
FIG. 2 shows an enlarged view of driver door 24 having control area 29 in accordance to an embodiment of the present invention.
Figure 3:
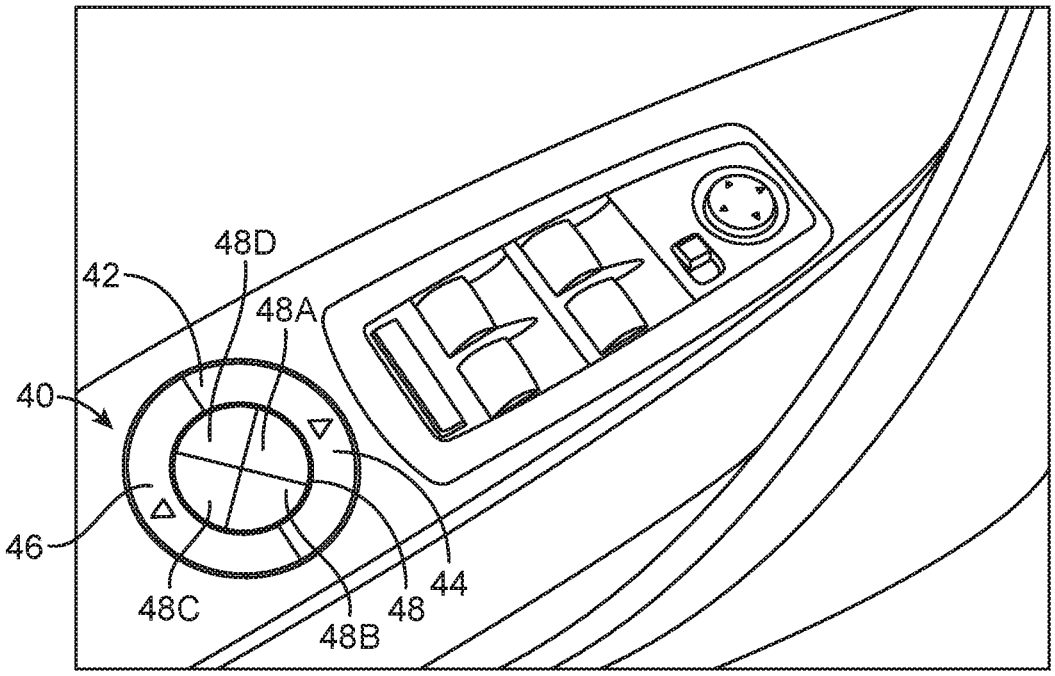
FIG. 3 illustrates an enlarged view of control assembly 40 mounted thereon vehicle assembly 20 in accordance to an embodiment of the present invention.

Referring now to the drawings, where the present invention is generally referred to with numeral 10, it can be observed a vehicle window control system 10 that basically includes a vehicle assembly 20 and a control assembly 40.

Vehicle assembly 20 includes a vehicle 22 having a driver door 24 and passenger doors 26. In the present embodiment, vehicle 22 is depicted as being a convention motor vehicle having four doors. However, it should be under stood that any suitable motor vehicle of any doors may be used for vehicle 22. Additionally, driver door 24 corresponds to the door on a driver's side of the vehicle. Furthermore, passenger doors 26 corresponds to the all of the other doors excluding driver door 24 of vehicle 22. Driver door 24 includes a driver window 24A. Driver window 24A is a vertically adjustable window that is disposed on driver door 24. Passenger doors 26 includes passenger windows 26A. Passenger windows 26A are also vertically adjustable windows disposed on passenger doors 26. Driver door 24 and passenger doors 26 further include electric motors 28 disposed therein. Electric motors 28 are communicably mounted to driver window 24A and passenger windows 26A.

Furthermore, electric motors 28 may be previously existing electric motors mounted within vehicle 22. Driver door 24 further includes a control area 29 wherein control assembly 40 is mounted thereon. Additionally, control assembly 40 is communicably mounted to electric motors 28 using known means in the art such as wires.

Control assembly 40 includes a switch panel 42 having a first switch 44 and a second switch 46. In the present embodiment, switch panel 42 may be circular in shape having a circumference and mounted thereon driver door 24. First switch 44 is mounted thereon switch panel 42 and has a shape that cooperates with half of the circumference of switch panel 42. Additionally, second switch 46 is also mounted thereon switch panel 42 and comprises a shape that cooperates with half of the circumference of switch panel 42. First switch 44 and second switch 46 may be single rocker type switches. In the present embodiment, once first switch 44 is actuated it then enables switch panel 42 to automatically sync driver window 24A and passenger windows 26A to switch panel 42. As a result, a user may utilize switch panel 42 to simultaneously control driver window 24A and passenger windows 26A. Additionally, once second switch 46 is actuated it then enables driver window 24A and passenger windows 26A to all be lowered a predetermined amount. Driver window 24A and passenger windows 26A will be lowered the predetermined amount once vehicle 22 is engaged. Switch panel 42 further includes a center switch 48 mounted in the center of switch panel 42 between first switch 44 and second switch 46. Switch panel 42 further includes a top button 48A, a right button 48B, a bottom button 48C, and a left button 48D communicably mounted to electric motors 28. Once engaged, the buttons may be configured to lower driver window 24A and passenger windows 26A a predetermined amount. The buttons may also include indicia thereon to indicate to a user the amount to be lowered. In the present embodiment, top button 48A may be configured to lower driver window 24A and passenger windows 26A twenty-five percent of the total height. Right button 48B may be configured to lower driver window 24A and passenger windows 26A fifty percent of the total height. Bottom button 48C may be configured to lower driver window 24A and passenger windows 26A seventy-five percent of the total height. Left button 48D may be configured to lower driver window 24A and passenger windows 26A one hundred percent of the total height. Vehicle window control system 10 allows a user to easily lower all the windows of a vehicle simultaneously.

The foregoing description conveys the best understanding of the objectives and advantages of the present invention. Different embodiments may be made of the inventive concept of this invention. It is to be understood that all matter disclosed herein is to be interpreted merely as illustrative, and not in a limiting sense.

What is claimed is:

1. A vehicle window control system, comprising:

a. a vehicle assembly, including a vehicle having a driver door and passenger doors, said driver door including a driver window and said passenger doors including passenger windows, said driver window and said passenger windows controlled by electric motors, wherein said driver door further includes a control area mounted thereon; and b. a control assembly, including a switch panel having a first switch and a second switch, said switch panel further including a center switch, said center switch includes a top button, a right button, a bottom button, and a left button, said top button, said right button, said bottom button, and said left button are configured to lower said driver window and said passenger windows a predetermined amount, said switch panel being circular in shape, wherein said first switch is defined by a first semi-circular frame of said switch panel, wherein said second switch is defined by a second semi-circular frame of said switch panel, wherein one said first switch is actuated it automatically syncs said driver window and said passenger windows to be simultaneously controlled by said center switch, wherein once said second switch is actuated each window is automatically lowered a predetermined amount when said vehicle is engaged.

2. The vehicle window control system of claim 1 wherein said electric motors are mounted within said driver door and said passenger doors.

3. The vehicle window control system of claim 1 wherein said electric motors are mounted within said driver door and said passenger doors, wherein said electric motors are electric motors previously existing in said vehicle.

4. The vehicle window control system of claim 1 wherein said first switch and said second switch are each a single rocker switch.

5. The vehicle window control system of claim 1 wherein said switch panel is circular in shape.

6. The vehicle window control system of claim 1 wherein said driver window and said passenger windows are vertically adjustable windows.

7. The vehicle window control system of claim 1 wherein said switch panel drives said electric motor based on a user's input.

8. A vehicle window control system, comprising:

a. a vehicle assembly, including a vehicle having a driver door and passenger doors, said vehicle being a conventional four door motor vehicle, said driver door including a driver window being vertically adjustable and said passenger doors including passenger windows being vertically adjustable, said driver window and said passenger windows controlled by electric motors, wherein said driver door further includes a control area mounted thereon; and b. a control assembly, including a switch panel having a first switch and a second switch, said switch panel drives said electric motors based on a user's input to said switch panel, said switch panel further including a center switch, wherein one said first switch is actuated it automatically syncs said driver window and said passenger windows to be simultaneously controlled by said center switch, wherein once said second switch is actuated each window is automatically lowered a predetermined amount when said vehicle is engaged, said switch panel being circular in shape and having a circumference, wherein said first switch envelops a first portion of half of the diameter of said switch panel, wherein said second switch envelops a second portion of half of the diameter of said switch panel, wherein said center switch is circular in shape is mounted in the center between first switch and said second switch, wherein said center switch includes a top button, a right button, a bottom button, and a left button configured to lower said driver window and said passenger windows a predetermined amount, wherein said first switch and said second switch are each a single rocker switch, wherein said top bottom lowers said passenger windows by twenty-five percent, wherein said right button lowers said windows by fifty percent, wherein said bottom button lowers said windows by seventy-five percent, wherein said left button lowers said windows by one-hundred percent.

* * * * *